US007686174B2

(12) United States Patent
Willim

(10) Patent No.: US 7,686,174 B2
(45) Date of Patent: Mar. 30, 2010

(54) VEHICLE CRANE WITH A TELESCOPIC BOOM, AS WELL AS PROCESS FOR ASSEMBLING AND DISASSEMBLING THE ANCHOR SUPPORTS OF THE TELESCOPIC BOOM

(75) Inventor: Hans-Dieter Willim, Ulm (DE)

(73) Assignee: Liebherr-Werk Ehingen GmbH, Donau (DE)

( * ) Notice: Subject to any disclaimer, the term of this patent is extended or adjusted under 35 U.S.C. 154(b) by 2086 days.

(21) Appl. No.: 10/379,304

(22) Filed: Mar. 4, 2003

(65) Prior Publication Data

US 2004/0000531 A1 Jan. 1, 2004

(30) Foreign Application Priority Data

Mar. 4, 2002 (DE) ..... 202 03 443 U
Jun. 25, 2002 (DE) ..... 102 28 345

(51) Int. Cl.
*B66C 23/42* (2006.01)

(52) U.S. Cl. ..... 212/298; 212/270; 212/294; 212/299

(58) Field of Classification Search ..... 212/298–300, 212/270, 294
See application file for complete search history.

(56) References Cited

U.S. PATENT DOCUMENTS 2,325,089 A 7/1943 Zeilman
4,434,994 A * 3/1984 Pepin ..... 280/404
4,967,917 A * 11/1990 Koizumi et al. ..... 212/300
5,240,129 A * 8/1993 Schrick et al. ..... 212/175
5,690,240 A * 11/1997 Thiermann, Sr. ..... 212/180
6,089,388 A * 7/2000 Willim ..... 212/298
6,481,587 B2 * 11/2002 Higgins ..... 212/298
6,550,624 B1 * 4/2003 Irsh et al. ..... 212/299
6,702,132 B1 * 3/2004 Moore et al. ..... 212/270

FOREIGN PATENT DOCUMENTS

DE 1751383 8/1957
DE 2109394 1/1972
DE 10022658 3/2001
DE 20020974 4/2002

* cited by examiner

*Primary Examiner*—Thomas J. Brahan
(74) *Attorney, Agent, or Firm*—Dillworth & Barrese, LLP.

(57) ABSTRACT

The within invention concerns a vehicle crane with a telescopic boom that can move on a horizontal axle and rotate on an upright axle with a pivot section, telescoping sections that can telescope out of the pivot section, and also with two anchor supports flexibly housed on one of the sections so that they can pivot out of transportation position, in which they are folded essentially parallel to each other against the section, and can be spread apart into an erect, particularly V-shaped, operation position. The invention also concerns a process for assembling or dissembling said anchor supports of the telescoping boom of the vehicle crane. According to the invention, when the boom is lying in essentially horizontal position, the anchor supports can be disassembled, are positioned on brackets provided next to the boom, and after the boom is raised are raised from the brackets and loaded by the boom itself.

17 Claims, 4 Drawing Sheets

VEHICLE CRANE WITH A TELESCOPIC BOOM, AS WELL AS PROCESS FOR ASSEMBLING AND DISASSEMBLING THE ANCHOR SUPPORTS OF THE TELESCOPIC BOOM

BACKGROUND OF THE INVENTION

The within invention concerns a vehicle crane with a telescoping boom that can luff on a horizontal axle and rotate on an upright axle, with a pivot section, telescoping sections that can telescope out of the pivot section, and two anchor supports housed flexibly on one of the sections, so that they can pivot out of transportation position, in which they are folded against the section essentially parallel to each other, into an upright operating position, particularly a V-shaped position. The invention also concerns a process for assembling and disassembling said anchor supports of the telescoping boom of the vehicle crane.

Telescoping booms of said type are regularly pivoted on the superstructure of the vehicle crane and can luff on a luffing cylinder jointed to the superstructure. The anchor supports are usually pivoted on the back of the telescoping boom in the upper portion of a pivot section, and are customarily mounted by means of hydraulic cylinders. The anchor supports can be anchored by means of cables or rods against the head of the inner telescoping section or a collar of the upper telescopic section as well as against the superstructure or the lower portion of the pivot section. For example, a crane boom known from DE-Gbm 1 751 383 is equipped with anchor supports positioned in a V shape symmetrical to its horizontal and vertical central plane, over which said anchor sections anchor components run to the top and bottom of the boom. The anchor supports can pivot on two axles, so that they can be folded out of their V-shaped operating position and against the pivot section for purposes of transportation. However, under certain circumstances this is not sufficient to permit the vehicle crane to travel through the streets. To meet the axle load regulations established by law, the telescoping bracing must be removed when necessary and loaded onto a low-bed trailer that travels with the vehicle crane. In vehicle cranes of the usual type, an additional auxiliary crane is necessary to lift the telescoping bracing off the vehicle crane and load it onto the low-bed trailer.

SUMMARY OF THE INVENTION

It is therefore the task of the within invention to create an improved vehicle crane as well as an improved process for assembling the anchor supports of the type initially described, to eliminate the disadvantages of the state of the art and perfect said state of the art in an advantageous manner. Preferably, a rapid and simple assembly or disassembly of the telescoping bracing should be achieved without an auxiliary crane.

According to the invention, this task is performed by means of a vehicle crane according to the description herein. With respect to the process, said task is performed by means of a process according to the description herein. Preferred embodiments of the invention are set forth herein.

According to the invention, for disassembly purposes the anchor supports are first deposited, with telescoping boom in lowered position, on brackets positioned next to the telescoping boom or on comparable surfaces, and are detached from the telescoping boom. The boom is then raised without the anchor supports. The anchor supports are then picked up by the telescoping boom itself from their intermediate position on the brackets, are lifted, and are loaded onto a low-bed trailer or similar equipment. For purposes of assembly, the sequence of steps can be reversed: The anchor supports are first picked up by the telescoping boom on which they are to be mounted and are laid on the brackets in pre-determined position and direction. The telescoping boom is then lowered so that it comes to rest between the anchor supports lying on the brackets. The anchor supports are then mounted on the boom. Needless to say, the predetermined anchor support position and the direction in which the anchor supports are initially positioned on the brackets are advantageously selected in such manner that the anchor supports with their boom connection components rest directly opposite the pertinent boom connection when the boom is lowered in the subsequent step.

By means of self-assembly of the anchor supports with the help of the telescoping boom itself, the telescopic bracing can be assembled and disassembled without a separate auxiliary crane. The said auxiliary crane thus does not have to be brought along.

The brackets or resting places for the anchor supports are appropriately positioned on the flat truck of the vehicle crane to the right and left next to the boom, when the boom is positioned lengthwise on the vehicle. Preferably the anchor supports are deposited on the brackets essentially horizontally and parallel to one another. In their transportation position, folded against the pivot section, they travel disassembled from the boom or assembled on the boom and folded against the pivot section.

To deposit the anchor supports for assembly in the correct position and direction on the brackets, positioning components can be provided on the brackets for the anchor supports, which said positioning components bring the anchor supports into the desired predetermined erection position when they are placed on the brackets. They can be, for example, positioning components that center and/or permit positive-locking deposit in only one position.

Advantageously, the anchor supports can be pivoted on at least one pivot axle relative to the boom sections to which they are attached, so that they can be erected and in particular spread apart to from a V shape. Pressure cylinders can regularly be assigned to the anchor supports to pivot the anchor supports appropriately. To facilitate assembly and disassembly, the pressure cylinders can be disassembled as a unit together with the anchor supports from the boom. Needless to say, however, the pressure cylinders can also remain on the boom and the anchor supports can be disassembled without the pressure cylinders.

According to an advantageous embodiment of the invention, a connector can be provided on each anchor support, for detachable connection with the individual boom section; advantageously, at least one pivot axle is provided between the connector and the anchor support, and the pressure cylinder is pivoted on the one hand to the connector and on the other hand to the anchor support. The anchor supports can be removed as a unit from the boom, said unit including the pivoted housing of the anchor supports as well as the pressure cylinder for pivoting of the anchor supports.

For additional ease of assembly and disassembly, the anchor supports are pivoted directly to the individual boom section, free of cross connections, erection frames, and the like. This means that each anchor support can be disassembled individually, without any need to first detach from other anchor supports.

BRIEF DESCRIPTION OF THE DRAWINGS

The invention is explained in greater detail below by means of one preferred embodiment and pertinent drawings. The drawings show.

DESCRIPTION OF THE PREFERRED EMBODIMENTS

Figure 1:
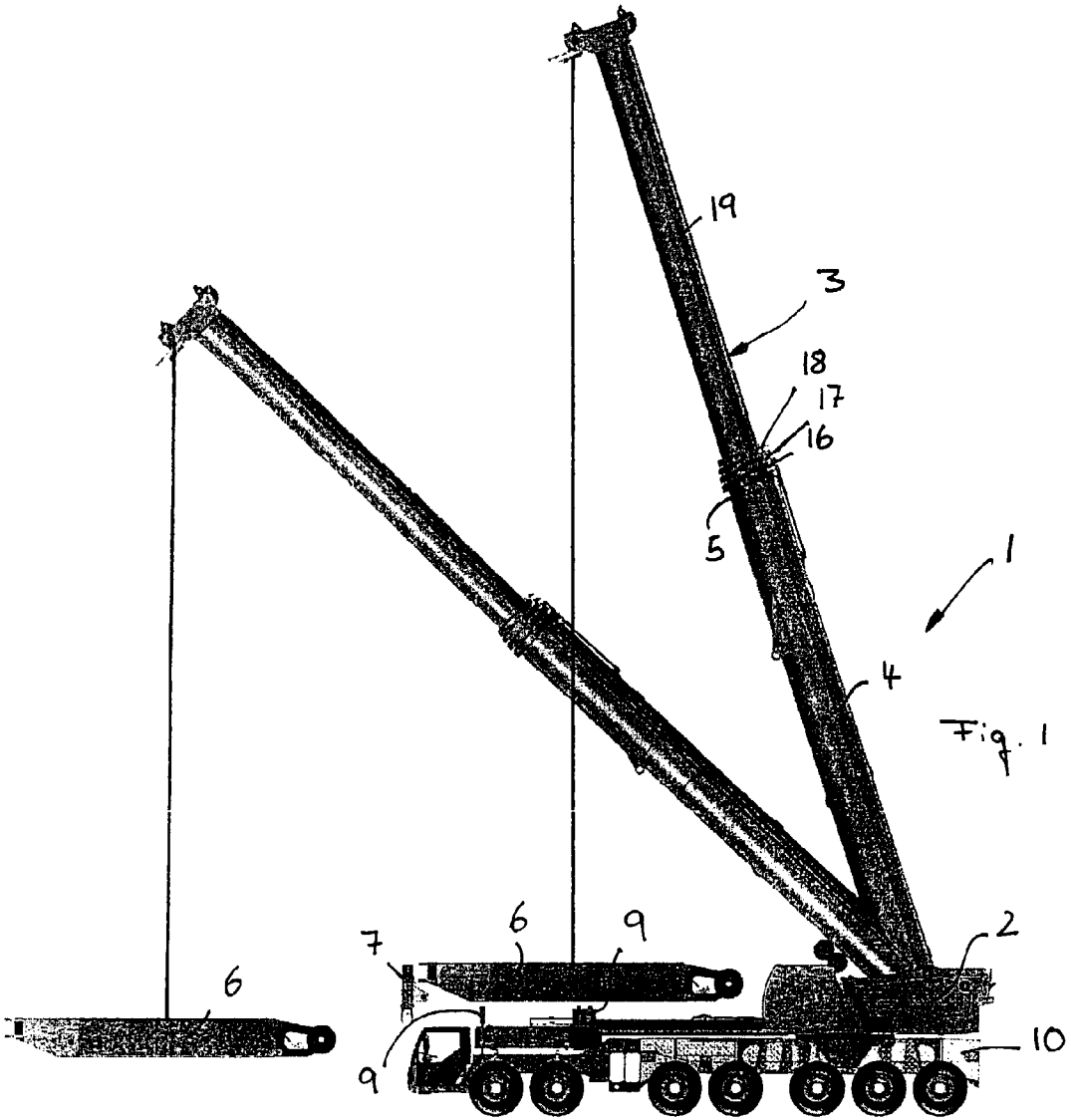
FIG. 1 A side view of a vehicle crane with telescopic boom during unloading by the boom itself of the anchoring supports for the boom bracing, with the boom being shown in two different luffing positions.

The vehicle crane 1 shown in the drawings has in known manner a superstructure 2 that can rotate on an upright shaft and which is positioned on the vehicle chassis. Pivoted on superstructure 2 is a telescoping boom 3 that luffs on a horizontal shaft and which consists of a pivot section 4 as well as telescoping sections 16, 17, 18, and 19 that can telescope out of said pivot section 4.

Two anchor supports 6 are pivoted to collar 5 of pivot section 4. Pivoted at the tops of anchor supports 6 are anchor cables or anchor rods, by means of which the anchor supports are anchored against the tops of the boom or the collar of an outward telescoping section and the superstructure or the lower portion of the pivot section. The anchor supports 6 are thus flexibly pivoted, so that they can be opened out of a position, shown in FIG. 2, in which they are folded against pivot section 4, and can be spread apart to form a V, in order to achieve additionally a lateral anchor of the telescoping boom.

Figure 5:
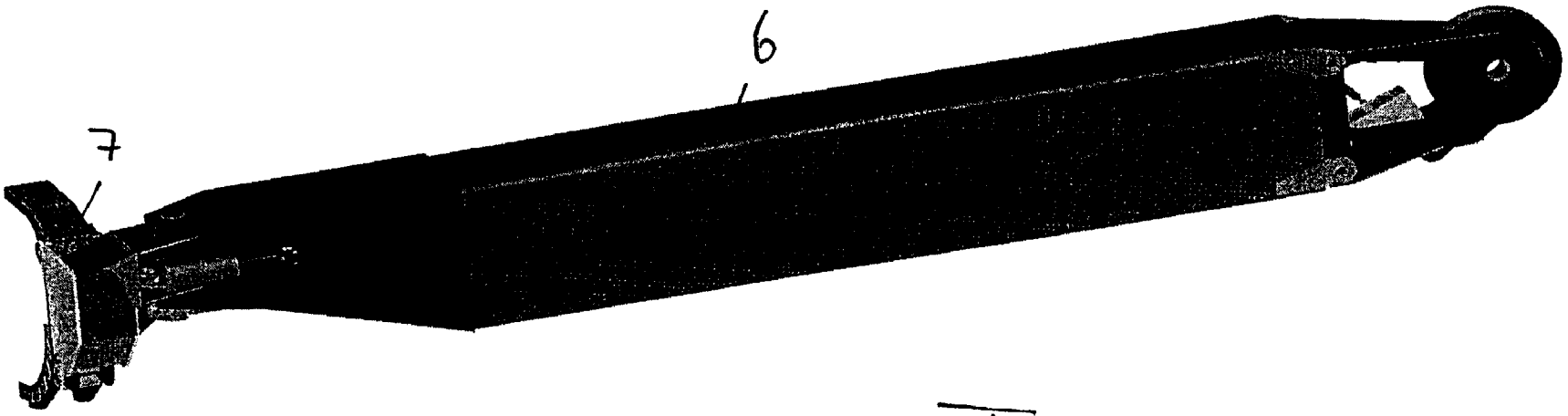
FIG. 5 A perspective view of a disassembled anchor support, showing its telescoping boom connector and its flexible connection with the anchor supports.

The anchor supports 6 can thus be detached from collar 5 of pivot section 4. As shown in FIG. 5 there is at the bottom of each and every anchor support 6 a half-shell telescoping boom connector 7 that can be bolted to collar 5 of pivot section 4. Anchor support 6 is connected with boom connector 7 by means of gimbals, that is, it can pivot on two shafts perpendicular to each other. By means of coordinated hydraulic cylinders 8 pivoted on the one hand to the individual anchor supports 6 and on the other hand to the individual boom connector 7, the anchor support 6 can be appropriately pivoted, if boom connector 7 is bolted to pivot section 4.

Figure 2:
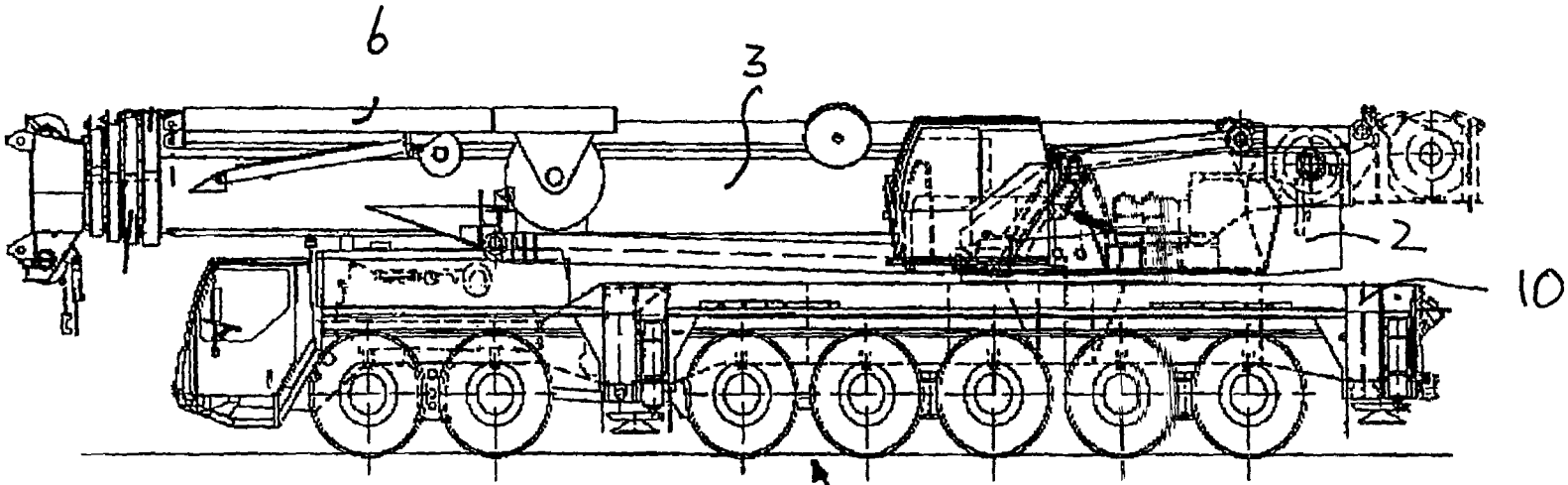
FIG. 2 A side view of the vehicle crane in FIG. 1, in which the telescoping boom is shown in horizontal position at rest on the vehicle, in which the anchor supports are folded against the pivot section of the boom and can be disassembled.
Figure 3:
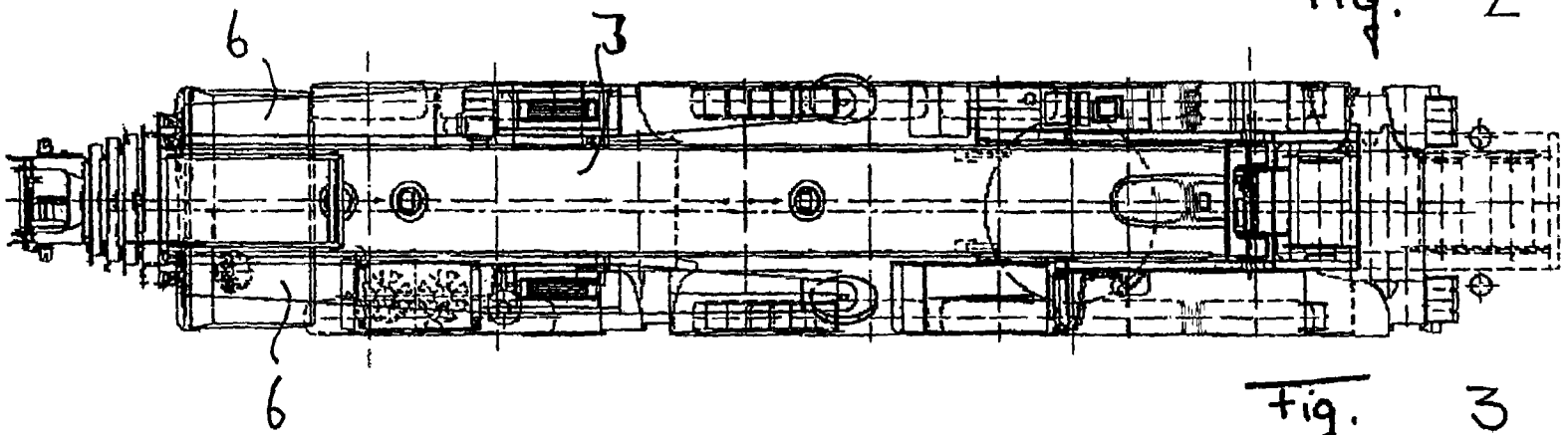
FIG. 3 A top view of the vehicle crane according to FIG. 2.
Figure 4:
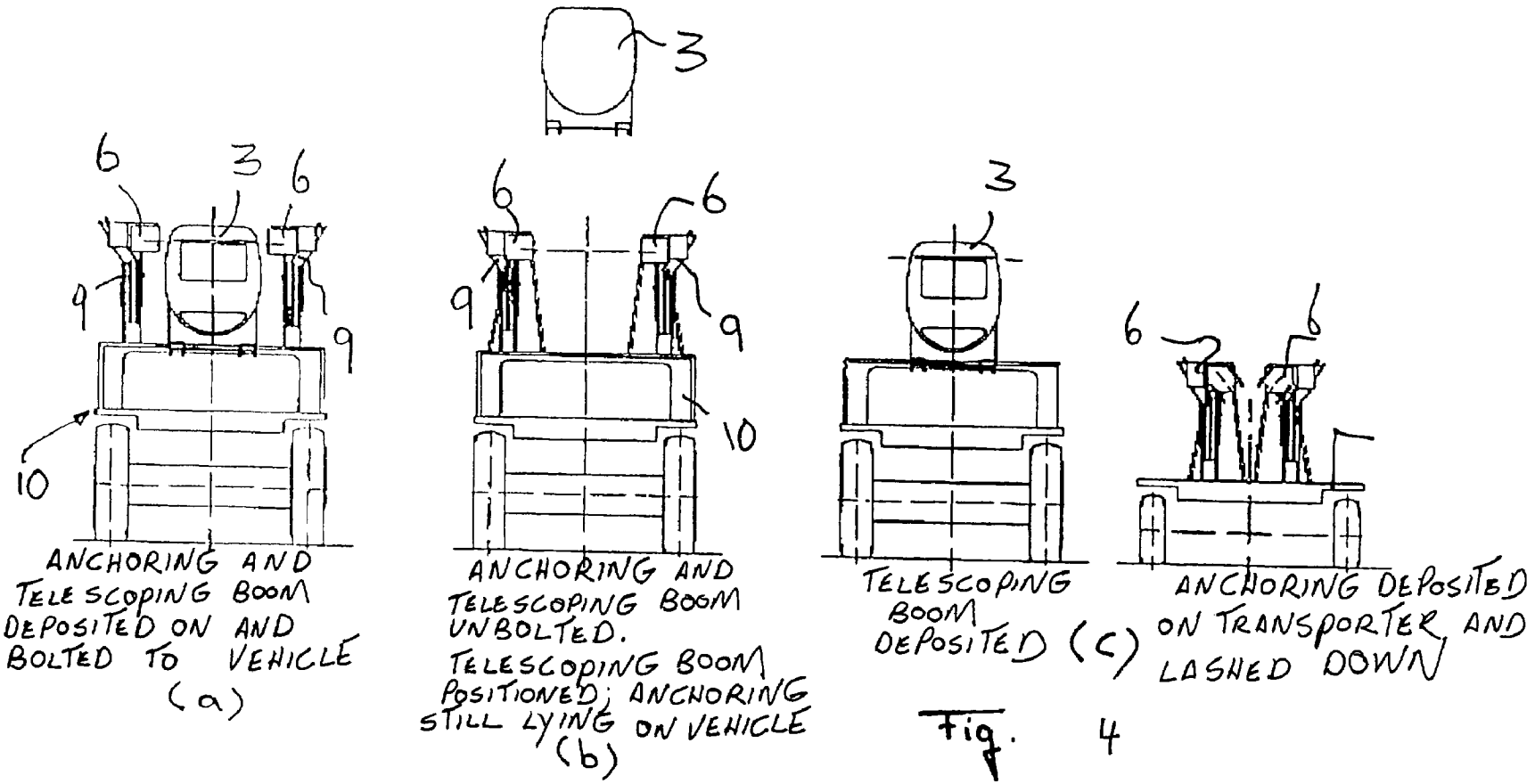
FIG. 4 A schematic process diagram for the vehicle crane of the preceding figures, which clarifies the disassembly of the anchor supports for the telescopic bracing and their loading by the crane boom itself onto a low-bed trailer.

As shown in FIGS. 2 and 3, when the boom is in horizontal position the two anchor supports 6 can rest on brackets 9 positioned on vehicle 10 to the right and left of the boom (cf. FIG. 1). As soon as the anchor supports 6 are rested on brackets 9, anchor supports 6 can be unbolted from the boom. The flexible connection formed by the pivot shafts can thereby be broken. Preferably, however, the entire boom connector 7 shown in FIG. 5 can be unbolted from pivot section 4, so that anchor supports 6 lie alone on brackets 9 on vehicle 10. After anchor supports 6 have been unbolted, boom 3 is raised, as shown in FIG. 1 and FIG. 4*b*, that is, boom 3 is used without anchoring, so that the crane itself can load anchor supports 6 on a low-bed trailer 16, as shown in FIG. 1 or FIG. 4*c*. The essential advantage here is that use of a previously customary and necessary auxiliary crane is not needed in order to remove the telescopic anchor. The telescoping anchor can be loaded with the crane itself onto the transporter, in order to comply with the axle-load provisions of law. As shown in FIG. 1, the unanchored stripped boom 3 as well as the hoisting-cable hoist running over boom 3 is used.

The invention claimed is:

1. Vehicle crane which comprises:

a vehicle chassis having a horizontal axle, an upright axle, and brackets;

a telescopic boom (3) that can luff on the horizontal axle and rotate on the upright axle with a pivot section (4), the telescopic boom (3) including first, second, third and fourth telescoping sections (16, 17, 18, 19) that can telescope out of the pivot section (4), and two anchor supports (6) connected to one of the telescoping sections or the pivot section so that said anchor supports are movable between a transportation position in which they are folded essentially parallel to each other against the telescoping or pivot section to which the anchor supports (6) are connected, and an operating position in which the anchor supports are spread apart into an erect, V-shaped, operating configuration, wherein the brackets are provided on the vehicle chassis next to the telescoping boom (3) such that when the telescoping boom (3) is lying in a horizontal position the anchor supports (6) can be removed from it and positioned on said brackets, from which said brackets the anchor supports (6) can be raised and/or unloaded by the telescoping boom (3) after appropriate luffing of boom (3).

2. Vehicle crane according to claim 1, in which pressure cylinders for pivoting the anchor supports (6) are pivoted to the anchor supports and can be disassembled, as a unit together with anchor supports (6), from the telescoping boom (3).

3. Vehicle crane according to claim 2, having on each anchor support (6) a telescoping boom connector (7) for detachable connection with a collar (5) associated with the pertinent boom section, at least one pivoting axle being provided between the boom connector (7) and the individual anchor support (6) wherein the pressure cylinder is pivoted to the boom connector (7) and to the anchor support (6).

4. Vehicle crane according to claim 3, in which the positioning components are provided on the brackets (9) to bring the anchor supports (6) into a predetermined assembly position when anchor supports (6) are laid on brackets (9).

5. Vehicle crane according to claim 2, in which the anchor supports (6) are pivoted directly to the individual boom section free of cross-connections or erection bridges.

6. Vehicle crane according to claim 5, in which the positioning components are provided on the brackets (9) to bring the anchor supports (6) into a predetermined assembly position when anchor supports (6) are laid on brackets (9).

7. Vehicle crane according to claim 2, in which the positioning components are provided on the brackets (9) to bring the anchor supports (6) into a predetermined assembly position when anchor supports (6) are laid on brackets (9).

8. Vehicle crane according to claim 1, in which the anchor supports (6) are pivoted directly to the individual boom section free of cross-connections or erection bridges.

9. Vehicle crane according to claim 8, in which the positioning components are provided on the brackets (9) to bring the anchor supports (6) into a predetermined assembly position when anchor supports (6) are laid on brackets (9).

10. Vehicle crane according to claim 1, in which positioning components are provided on the brackets (9) to bring the anchor supports (6) into a predetermined assembly position when anchor supports (6) are laid on brackets (9).

11. Vehicle crane according to claim 10, in which the anchor supports (6) are pivoted directly to the individual boom section free of cross-connections or erection bridges.

12. Vehicle crane according to claim 11, in which the positioning components are provided on the brackets (9) to bring the anchor supports (6) into a predetermined assembly position when anchor supports (6) are laid on brackets (9).

13. Process for assembling or disassembling anchor supports (6) a telescopic boom (3) of a vehicle crane, having the following assembly steps:

Grasping and hoisting of the disassembled anchor supports (6) by the boom (3) itself from a low-bed trailer or similar equipment;

Depositing of the disassembled anchor supports (6) on brackets (9) on a vehicle chassis at intervals from one another and in predetermined position relative to the vehicle crane;

Positioning of the boom (3) between the anchor supports (6) deposited on brackets (9); and Attachment of anchor supports (6) to an anchor support connector (5) of one of the boom (3) sections.

14. Process according to claim 13, in which the anchor supports (6) are laid on the brackets (9) in essentially horizontal position and/or parallel to one another; and the boom (3) is moved horizontally lengthwise along the vehicle.

15. Process according to claim 13, in which the following disassembly steps are performed:

Positioning of boom (3) with the anchor supports (6) mounted on it between two brackets (9) on a vehicle chassis, until anchor supports (6) are lying on the brackets or are directly above the brackets;

Depositing of the anchor supports (6) on the brackets (9), whereupon the anchor supports are detached from the boom;

Movement of the boom (3) without anchor supports (6);

Grasping and hoisting of the disassembled anchor supports (6) lying on brackets (9) by the boom (3) itself, and Depositing of the anchor supports (6) on a transporter.

16. Process for disassembling anchor supports (6) of a telescopic boom (3) of a vehicle crane, having the following disassembly steps:

Positioning of boom (3) with the anchor supports (6) mounted on it between two brackets (9) on a vehicle chassis, until anchor supports (6) are lying on the brackets or are directly above the brackets;

Depositing of the anchor supports (6) on the brackets (9), whereupon the anchor supports are detached from the boom;

Movement of the boom (3) without anchor supports (6)

Grasping and hoisting of the disassembled anchor supports (6) lying on brackets (9) by the boom (3) itself, and Depositing of the anchor supports (6) on a transporter.

17. A mobile crane having a telescopic boom (3) which can be tilted about a horizontal axis and rotated about an upright axis, said mobile crane having an attachment section (4), telescopic sections (16, 17, 18, 19) which can be telescoped out of the attachment section (4), and two support braces (6), which are pivotally mounted in an articulated manner on one of the sections (4, 16, 17, 18, 19) and moveable between a transport position in which the support braces (6) are substantially parallel to each other and an upright operating position in which the anchor supports (6) are in a substantially V-shaped configuration, wherein, when the telescopic boom is in a substantially horizontal position the support braces (6) can be dismantled from the telescopic boom and can be deposited on spaced-apart brackets mounted on a chassis of the mobile crane on a right side and a left side of the mobile crane chassis adjacent the telescopic boom (3) from which brackets the support braces (6) can be moved by the telescopic boom (3) itself after the telescopic boom has been tilted to an upright position.

* * * * *